US009039641B1

(12) United States Patent
Johnson

(10) Patent No.: US 9,039,641 B1
(45) Date of Patent: May 26, 2015

(54) MASSAGE APPARATUS

(76) Inventor: Ronald B. Johnson, Casa Grande, AZ (US)

( * ) Notice: Subject to any disclaimer, the term of this patent is extended or adjusted under 35 U.S.C. 154(b) by 508 days.

(21) Appl. No.: 13/358,291

(22) Filed: Jan. 25, 2012

(51) Int. Cl.
*A61H 15/00* (2006.01)

(52) U.S. Cl.
CPC ..... *A61H 15/00* (2013.01); *A61H 15/0092* (2013.01)

(58) Field of Classification Search
CPC ..... A63B 43/002; A63B 67/002; A63B 69/0053; A63H 2027/1075; A61H 15/00; A61H 15/0092
USPC ..... 601/131, 132, 134–137, 118, 120, 129; D24/211, 214, 215; D21/707, 713
See application file for complete search history.

(56) References Cited

U.S. PATENT DOCUMENTS

| | | | | | |
|---|---|---|---|---|---|
| 563,170 | A | | 6/1896 | Haley et al. | |
| 744,718 | A | * | 11/1903 | Cassidy | 601/131 |
| 1,299,092 | A | * | 4/1919 | Abrahamson | 473/595 |
| 2,078,382 | A | | 4/1937 | Hanshaw | |
| 2,286,324 | A | * | 6/1942 | Wentz | 601/120 |
| 2,362,064 | A | | 11/1944 | Giesinger | |
| 2,466,470 | A | | 4/1949 | Norris | |
| 4,191,178 | A | * | 3/1980 | Wisnieski | 601/131 |
| 4,308,860 | A | * | 1/1982 | Sanders et al. | 601/137 |
| 4,648,387 | A | * | 3/1987 | Simmons | 601/120 |
| 4,846,159 | A | | 7/1989 | Anzai et al. | |
| D317,805 | S | | 6/1991 | Swan | |
| 5,028,053 | A | | 7/1991 | Leopold | |
| 5,131,665 | A | | 7/1992 | Myers | |
| 5,251,908 | A | | 10/1993 | Myers | |
| D358,858 | S | | 5/1995 | McGreevy | |
| 5,577,996 | A | * | 11/1996 | Gardner et al. | 601/120 |
| D393,671 | S | * | 4/1998 | Honaker | D21/707 |
| 5,906,530 | A | * | 5/1999 | Lindsey | 446/85 |
| D435,660 | S | | 12/2000 | Yoo | |
| 6,245,031 | B1 | | 6/2001 | Pearson | |
| D456,570 | S | | 4/2002 | Tsengas | |
| 6,379,212 | B1 | * | 4/2002 | Miller | 446/85 |
| 6,432,071 | B1 | * | 8/2002 | Hsieh | 601/72 |
| 6,443,863 | B1 | | 9/2002 | Dinoffer | |
| D478,367 | S | | 8/2003 | Traub | |
| D516,640 | S | | 3/2006 | Shore | |
| 7,238,161 | B2 | | 7/2007 | Komkin et al. | |

(Continued)

OTHER PUBLICATIONS

Pentakis Dodecahedron, Wolfram MathWorld, Aug. 27, 2010, <http://mathworld.wolfram.com/PentakisDodecahedron.html>., accessed online on Oct. 10, 2014.*

(Continued)

*Primary Examiner* — Justine Yu
*Assistant Examiner* — Christopher Miller
(74) *Attorney, Agent, or Firm* — Booth Udall Fuller, PLC

(57) ABSTRACT

A massage device is disclosed and may include a substantially solid body with an array of at least twenty, and in some cases thirty or thirty-two or more, massage fingers each with an outward tip, an inward base and a center axis, the center axis extending to a center of the body. The massage fingers are spaced about the body at substantially equal distances from each of at least three, and in some cases up to five or six, massage fingers nearest to each massage finger such that the center axis of each massage finger is spaced and positioned to correspond to a location of one of at least twenty vertices of a polyhedron, in some cases a pentakis dodecahedron, and aligns with a vertex axis extending from a polyhedron center point through one of the vertices of the polyhedron.

19 Claims, 9 Drawing Sheets

(56) References Cited

U.S. PATENT DOCUMENTS

| | | | | | |
|---|---|---|---|---|---|
| 7,413,524 | B1 | | 8/2008 | Bibby | |
| 7,458,945 | B2 | | 12/2008 | Zemont | |
| D585,162 | S | | 1/2009 | Partain et al. | |
| D599,963 | S | | 9/2009 | Crane et al. | |
| D601,645 | S | | 10/2009 | Chapa, Jr. | |
| D617,395 | S | | 6/2010 | Colangelo et al. | |
| D619,663 | S | | 7/2010 | Quinn | |
| D625,426 | S | | 10/2010 | Robins | |
| D626,610 | S | | 11/2010 | Grimm | |
| D629,056 | S | | 12/2010 | Grimm | |
| D650,874 | S | * | 12/2011 | Williams | D21/713 |
| D695,371 | S | * | 12/2013 | Hedeen, Jr. | D21/713 |
| 2004/0006294 | A1 | * | 1/2004 | Zemont | 601/135 |
| 2004/0230146 | A1 | * | 11/2004 | Chang | 601/134 |
| 2005/0033205 | A1 | * | 2/2005 | Komkin et al. | 601/131 |
| 2006/0089578 | A1 | * | 4/2006 | Hsu | 601/118 |
| 2008/0039747 | A1 | * | 2/2008 | Baerwalde et al. | 601/15 |

OTHER PUBLICATIONS

"Pentakis Dodecahedron" Wikipedia. Mar. 12, 2001.

"Massage Tool for Back Pain Neck Pain Sore Muscles" Healthy Body Ball. http://www.healthybodyball.com.

* cited by examiner

MASSAGE APPARATUS

BACKGROUND

1. Technical Field

Aspects of this document relate generally to body massaging apparatuses.

2. Background Art

Massage balls and other apparatus are often used to treat or relax muscles. Typical massage balls comprise a ball with various points or knobs placed sporadically or in some pattern across the surface of the ball. These and other massage balls pose several problems in the utilization of the massage ball. First, if the massage ball has points or knobs that are too close together or too small, the massage ball is not effective in muscle treatment. When a ball with too many points or knobs is rolled over a muscle, the muscle recognizes or responds to only a spherical shape because of the close proximity of the relative contact points. Thus, the knobs or points are rendered useless. Second, massage balls with too few points or knobs do not roll smoothly. As a result, the knobs or points typically apply too much pressure in a disjointed fashion before sporadically rotating to the next knob or point in contact with the body. This is particularly the case for massage balls which are used in a fashion where they are placed on the ground and the user rolls the ball between the user's body and the ground or other firm surface. Sporadic or uneven rolling makes it difficult to treat the muscle predictably. Third, some massage balls are inflatable or air-filled apparatuses. These apparatuses, however, are prone to collapsing under pressure when applied in use. The collapse prevents effective use of the massage ball.

SUMMARY

According to a first aspect, a massage apparatus may comprise a substantially solid body comprising an array of at least twenty massage fingers each comprising an outward tip, and inward base, and a center axis central to the outward tip and the inward base, the center axis extending to a center of the body, wherein each of the at least twenty massage fingers are spaced about the body at substantially equal distances from each of at least three massage fingers nearest to each massage finger of the at least twenty massage fingers such that the center axis of each massage finger is spaced and positioned to correspond to a location of one of at least twenty vertices of a polyhedron and aligns with one of at least twenty vertex axis extending from a polyhedron center point through one of the at least twenty vertices of the polyhedron.

Particular embodiments and implementations may comprise one or more of the following. The array of at least twenty massage fingers may comprise an array of twenty to thirty-two massage fingers. The array of twenty to thirty-two massage fingers may comprise thirty-two massage fingers, the polyhedron comprises a pentakis dodecahedron with thirty-two vertices, and the substantially equal distances from the at least three massage fingers nearest to each massage finger comprises a substantially equal relative distance ratio of approximately 0.9:1.0 from at least five massage fingers nearest to each massage finger of the thirty-two massage fingers. The massage fingers may be substantially conical. The outward tip of each massage finger may be flat. The outward tip of each massage finger may be rounded. Intersecting edges of massage fingers and the body may be filleted. The massage fingers may be substantially cylindrical. The body may comprise a substantially spherical body. The polyhedron may comprise a pentakis dodecahedron with thirty-two vertices and the array of at least twenty massage fingers comprises at least thirty massage fingers, each center axis of the at least thirty massage fingers aligning with the vertex axis of one of the thirty-two vertices of the pentakis dodecahedron. The center axes of the thirty massage fingers may each be aligned with the vertex axis of one of the thirty-two vertices of the pentakis dodecahedron such that two vertices of the thirty-two vertices on opposing sides of the body are void of massage fingers. The two vertices void of massage fingers may each comprise a recessed receiving element. The massage apparatus may further comprise a bar extending through the body such that the body is pivotally mounted on the bar. The massage apparatus may further comprise a second body pivotally mounted to the bar adjacent to the first body. The body may comprise a thermoplastic elastomer material.

According to another aspect, a massage apparatus may comprise an array of thirty-two massage fingers arranged on a body such that a center axis of each of the thirty-two massage fingers aligns with one of thirty-two vertex axes that extend from a body center point formed by an intersection corresponding to each vertex axis to one of thirty-two vertices of a pentakis dodecahedron; wherein each massage finger of the thirty-two massage fingers is spaced substantially equally from at least five massage fingers nearest to each massage finger of the thirty-two massage fingers at a distance ratio of approximately 0.9:1.0.

Particular implementations and embodiments may comprise one or more of the following. The thirty-two massage fingers may each be substantially conical in shape and comprise an inward base and an outward tip, the outward tip smaller in area and at a greater distance from the center point than the inward base. Intersections formed by intersection of the massage fingers and the body may be filleted. The body may be spherical.

According to another aspect, a massage apparatus may comprise an array of at least twenty massage fingers each comprising an outward tip and extending from a body, each outward tip of the at least twenty massage fingers spaced substantially equally from tips of at least three massage fingers nearest to each massage finger of the at least twenty massage fingers at a relative distance ratio of approximately 0.9:1.0.

Particular implementations and embodiments may comprise one or more of the following. The at least twenty massage fingers may comprise thirty-two massage fingers and the relative spacing of the at least three massage fingers nearest to each massage finger applies to the relative spacing of at least five massage fingers nearest to each massage finger. The massage fingers may be substantially conical. An intersection formed by each massage finger and the body may be filleted. The body may be substantially spherical.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Detailed Description or Description of the Drawings or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The disclosure will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended massage apparatuses and/or assembly procedures for massage apparatuses will become apparent for use with implementations of massage apparatuses from this disclosure. Accordingly, for example, although particular massage apparatuses are disclosed, such massage apparatuses and implementing components may comprise any shape, size, style, type, model, version, measurement, concentration, material, quantity, and/or the like as is known in the art for such massage apparatuses and implementing components, consistent with the intended operation of massage apparatuses.

Figure 1:
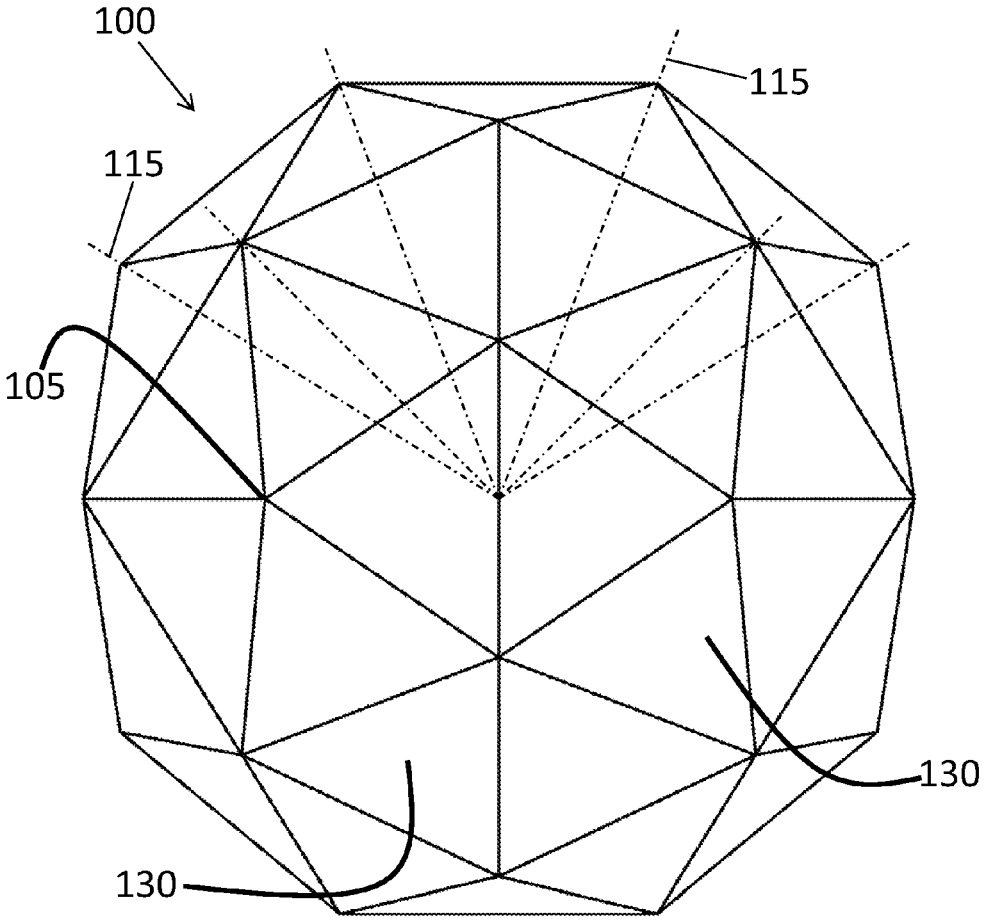
FIG. 1 is a front view of a pentakis dodecahedron.

Various implementations of massage apparatuses are disclosed herein. Some implementations use a variety of a platonic and a non-platonic three-dimensional geometric polyhedron as a basis for configuration of massage fingers on the massage apparatus. Such polyhedron figures may include, but are not limited to tetrahedrons, octahedrons, cubes, icosahedrons, dodecahedrons, pentakis dodecahedrons, pentagonal icositetrahedrons, or triakis icosahedrons. Each polyhedron comprises a corresponding number of vertices and faces, as well as a specific dihedral angle. A dihedral or torsion angle is the angle between two planes. Accordingly, a tetrahedron comprises four vertices and a dihedral angle of 70.53 degrees. An octahedron comprises six vertices and a dihedral angle of 109.47 degrees. A cube comprises eight vertices and a dihedral angle of 90.00 degrees. An icosahedron comprises twelve vertices and a dihedral angle of 138.19 degrees. A dodecahedron comprises twenty vertices and a dihedral angle of 116.57 degrees. A pentagonal icositetrahedron comprises 38 vertices and a dihedral angle of 136.33. A triakis icosahedron comprises 32 vertices and a dihedral angle of 160.61. A pentakis dodecahedron 100 is illustrated in FIG. 1, and comprises thirty-two vertices 105, sixty faces 130, and a dihedral angle of 156.72 degrees. FIG. 1 also illustrates a vertex axis 115 that extends from the three-dimensional center of the pentakis dodecahedron through a vertex 105.

Various implementations of a massage ball may utilize any three-dimensional polyhedron listed herein or otherwise in a configuration of a massage apparatus. As shall be described in greater detail with respect to FIGS. 2-6, a massage apparatus may comprise an array of massage fingers or protrusions, the centers of which align with vertex axes that extend from a center of a theoretical three-dimensional figure through vertices of the theoretical three-dimensional figures.

For effective use, massage fingers or protrusions on a massage apparatus must be spaced far enough apart to stimulate individual points within soft tissue of a person on whom the massage the massage apparatus is being utilized. On the other hand, effective use of a massage apparatus is greatly enhanced when the massage fingers or protrusions are spaced close enough and relatively uniformly across the massage apparatus to enable both easy and predictable translation/rolling of the massage apparatus between the user's body and the opposing surface.

Accordingly, specific implementations of a massage apparatus may utilize a polyhedron comprising at least twenty vertices and not more than forty vertices as a base geometric shape for the massage apparatus. At least twenty massage fingers or protrusions spaced at substantially equal spacing across a massage apparatus provides a massage apparatus that is advantageous to prior art because the massage fingers or protrusions are far enough apart to allow for proper stimulation of individual points within soft tissue of the receiver, while close enough and uniformly spaced to enable easy and predictable translation/rolling of the massage apparatus.

Implementations utilizing a platonic polyhedron, such as a dodecahedron, as a base for the massage apparatus comprise massage fingers at an equal distance from the nearest massage fingers. Particular therapeutic advantage has been found in implementations using a non-platonic polyhedron, such as a pentakis dodecahedron, as a base for a massage apparatus, the massage fingers may be at substantially or nearly equal spacing from the nearest massage fingers. For example, in a massage apparatus utilizing a pentakis dodecahedron, the ratio of distances between nearest and furthest adjacent vertex axes or massage fingers is approximately 0.9:1:0.

Figure 9:
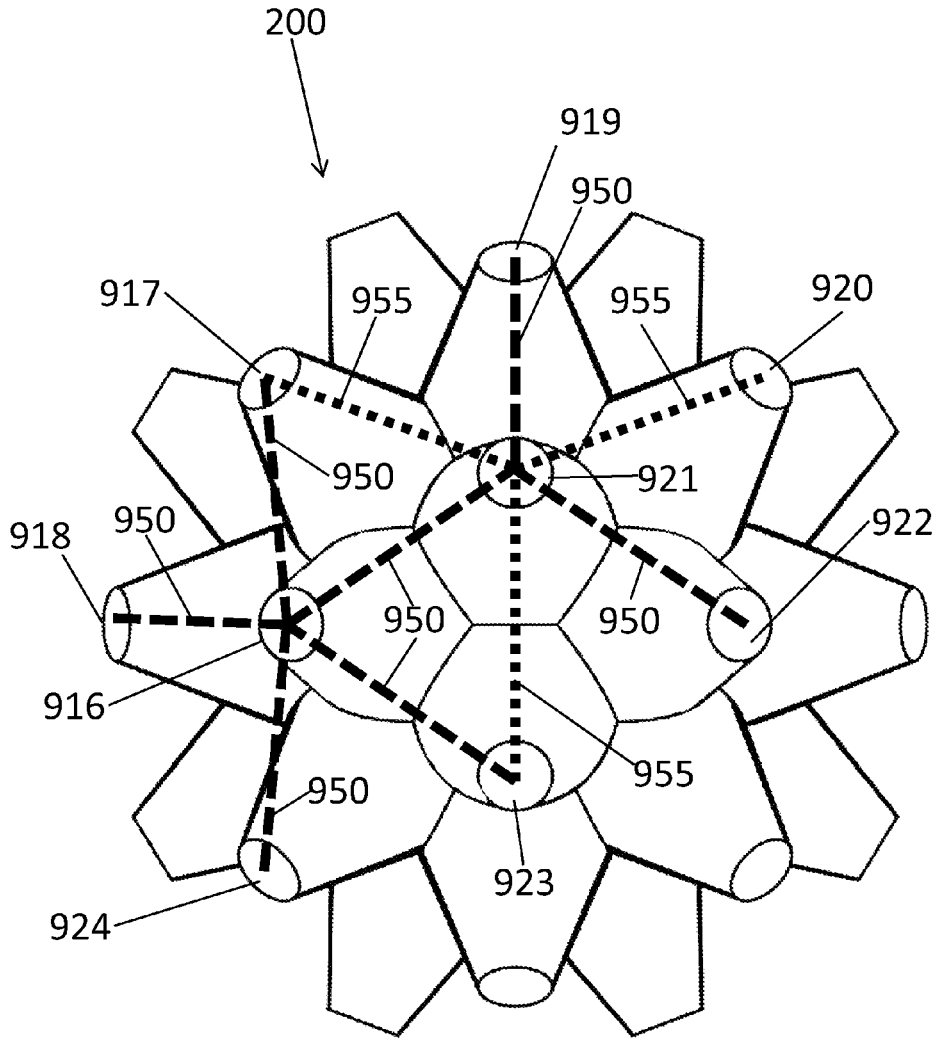
FIG. 9 is a perspective view of a massage apparatus illustrating the respective distances between massage fingers.

In a pentakis dodecahedron, twenty vertices of the thirty-two vertices are each surrounded by six vertices, while the remaining twelve vertices are surrounded by five vertices. As illustrated in FIG. 9, for a massage finger 916 surrounded by only five massage fingers 917, 918, 921, 923, 924, the first or lesser distance 950 between the central massage finger 916 and each of the five surrounding massages fingers 917, 918, 921, 923, 924 is an equal distance 950. A massage finger 921 surrounded by six massage fingers 916, 917, 919, 920, 922, 923 comprises three fingers 917, 920, 923 at a second or greater distance 955 than the first or lesser distance 950 between the massage finger 921 and the remaining three massage fingers 916, 919, 922. In an implementation, the relative ratio of the lesser distance 950 to the greater distance 955 is approximately 0.9:1.0. Each of the twenty vertices or massage fingers surrounded by only five vertices or massage fingers may comprise a pattern similar to that illustrated in FIG. 9, specifically each of the five surrounding vertices or massage fingers are at the same distance from the central massage finger. Likewise, each of the twelve vertices or massage fingers surrounded by six vertices or massage fingers may comprise a pattern similar to that illustrated in FIG. 9. Specifically, the three lesser distanced and three greater distanced massage fingers may alternate in placement around the central massage finger. The precise distance ratio between the lesser distance 950 and the greater distance 955 may be calculated with the formula: $18*(2*\sqrt{5}-1)/57*(\sqrt{5}-1)=0.887058$, or approximately 0.9:1.0. The same spacing configuration between massage fingers of FIG. 9 may be applied to any implementation disclosed herein, and is not limited to the implementation illustrated in FIG. 9.

Figure 2:
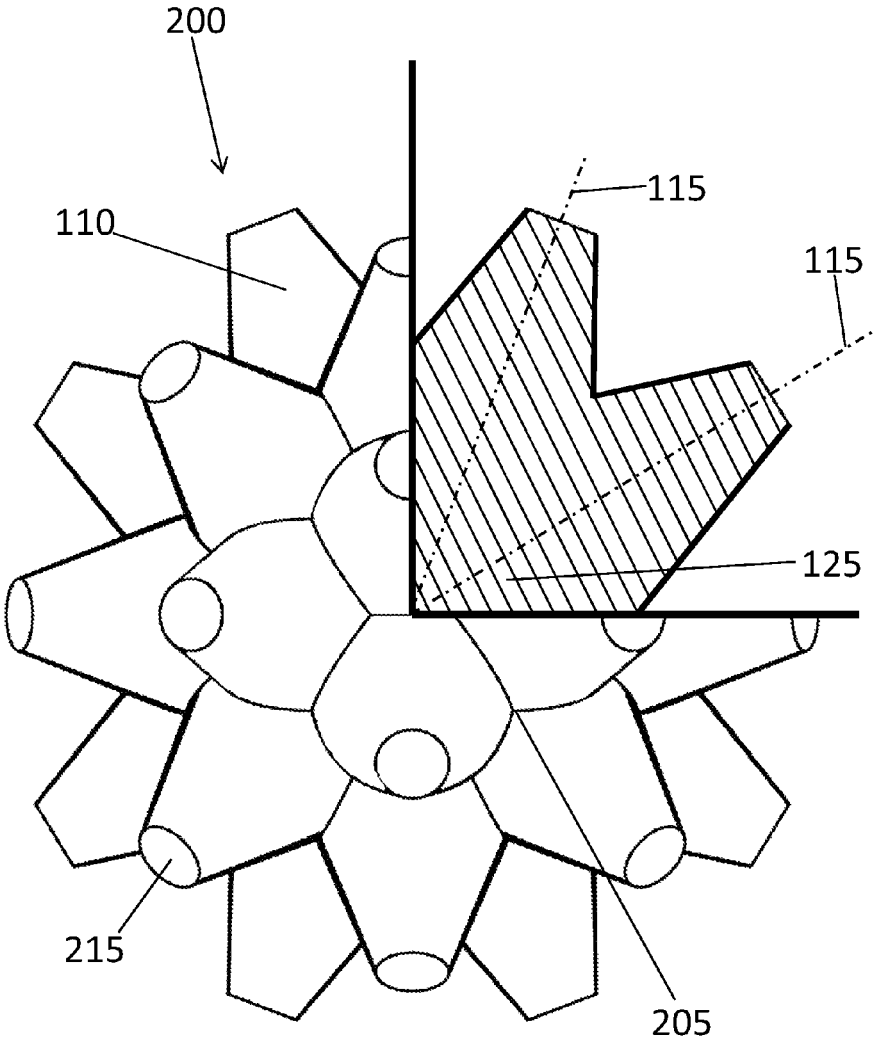
FIG. 2 is a partial cross-sectioned front view of first implementation of a massage apparatus.

Referring now to FIG. 2, a partial cross-section view of an implementation of a massage apparatus 200 is illustrated. According to a particular implementation, a massage apparatus 200 may comprise an array of merged massage fingers 110 around a central massage apparatus body 125. The massage fingers 110 of massage apparatus 200 are substantially conical or frustoconical in shape with a flat outward tip 215 and an inward base 205. As shall be shown in other implementations, the massage fingers 110 may comprise any shape and any tip and/or base configuration. In FIG. 2, the inward bases 205 of the massage fingers 110 intersect to form a central body 125. In other implementations, the massage fingers may be coupled or configured to a body 125 in any manner.

The implementation of FIG. 2 utilizes a theoretical pentakis dodecahedron base and comprises thirty-two massage fingers 110 spaced to correspond with the spacing of the thirty-two vertices of a theoretical pentakis dodecahedron base shape, whether the actual shape of the base is a pentakis dodecahedron, a sphere, or any other shape. The massage fingers 110 may be aligned such that a center axis 115 central to the outward flat tip 215 and the inward base 205 of the massage apparatus 200 extends from a center of the body 125 through the center of the inward base 205 and outward tip 215. For relative positioning of the massage fingers 110, the center of the body 125 is aligned with a center of the theoretical polyhedron, specifically in this implementation the center of the pentakis dodecahedron for aligning of the massage fingers 110 with the locations of where the vertices of the pentakis dodecahedron would exist. The center axes 115 of the massage apparatus 200 is positioned so as to correspond with the vertex axes 115 of the shape illustrated in FIG. 1.

Other implementations similar to massage apparatus 200 may comprise any number of massage fingers 110 aligned positioned to correspond with the vertices of any type of polyhedron. For example, an implementation may comprise a dodecahedron as a base polyhedron shape for a massage apparatus. Such an implementation may then comprise twenty massage fingers, each equally spaced from the three nearest massage fingers. Furthermore, the center axes of the twenty massage fingers 110 would align with the locations of the twenty vertex axes of a dodecahedron extending from a center of the dodecahedron to each of the twenty vertices.

The massage apparatus 200 and other massage apparatuses disclosed herein may comprise a variety of sizes and hardness measurements. Particular implementations may comprise a massage apparatus with a diameter of between two and six inches from the outer tip of a massage finger 110 to the outer tip of a massage finger on an opposing side of the massage apparatus. While implementations may comprise a variety of materials, such as but not limited to rubbers, foams, plastics, inflatables, and the like, in a particular implementation, the massage apparatus comprises a thermoplastic elastomer or natural rubber. In particular implementations, the hardness ranges from forty to eighty Shore A durometers. Other sizes and hardnesses may be used depending upon the particular size and weight of the user, the particular area of the body being treated, and the particular massage therapy being administered.

Figure 3:
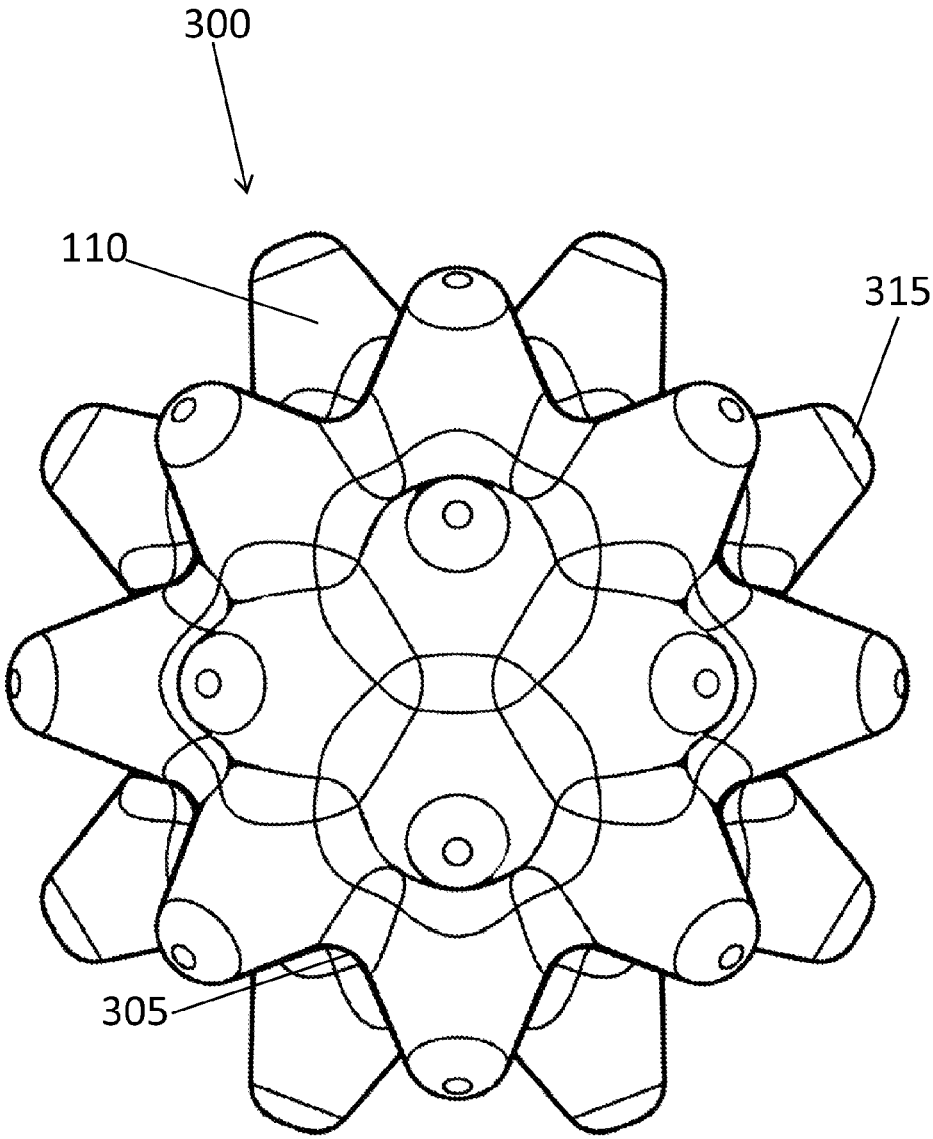
FIG. 3 is a front view of a second implementation of a massage apparatus.

Referring now to FIG. 3, illustrating a massage apparatus 300 comprising a rounded tip 315 on each massage finger 110 and a filleted edge 305 or intersection at the intersection of the inward base of each massage finger 110 with other surrounding massage fingers 110. The plurality of massage fingers 110 on massage apparatus 300 may be arranged and spaced based on a theoretical polyhedron as previously described. The massage fingers 110 of FIG. 3 are substantially conical in shape, while massage fingers 110 for this or any other implementation may comprise any shape, such as but not limited to cylindrical, cubical, spherical, diamond shaped, and the like.

In specific implementations, the apex angle of the cone-shaped massage fingers 110 is between twenty and sixty degrees. The height of massage fingers 110 from the rounded tip 315 to the filleted edge 305 is greater than 0.25 inches. Other implementations may comprise any angle and any massage finger 110 height.

Figure 4:
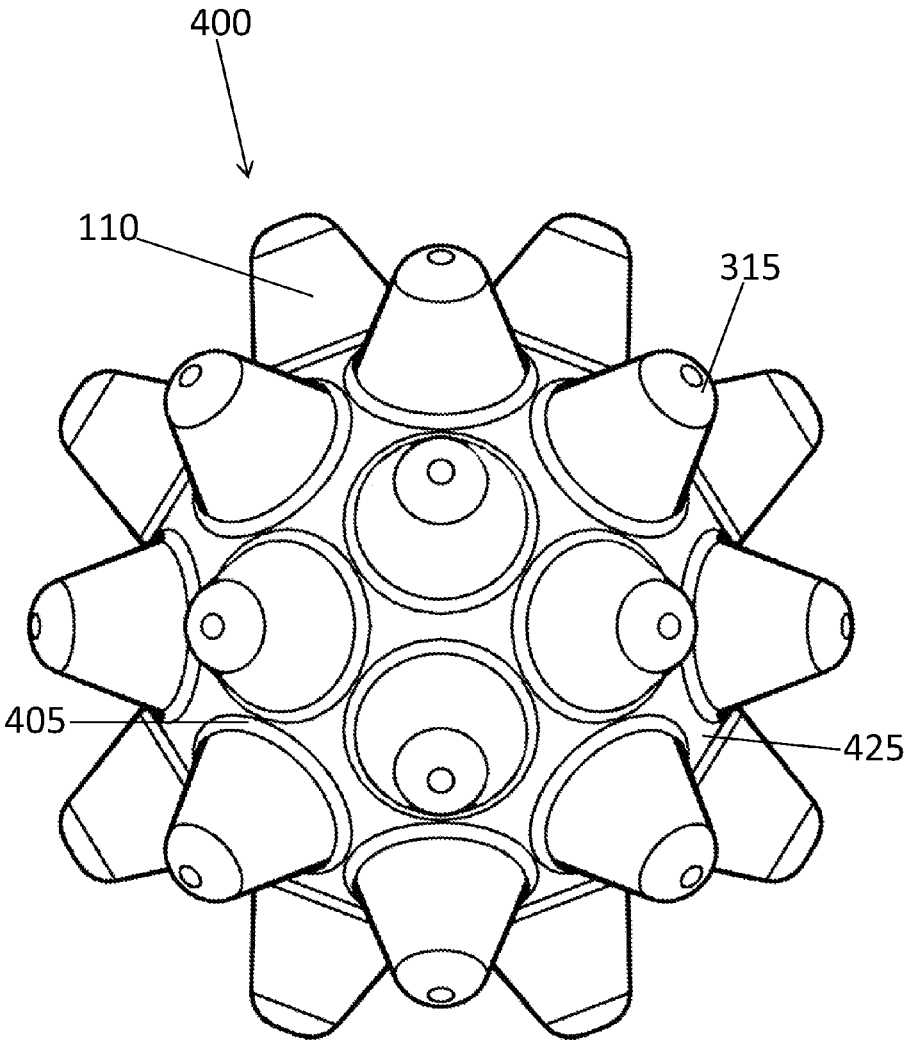
FIG. 4 is a front view of a third implementation of a massage apparatus.

Referring now to FIG. 4, illustrating a massage apparatus 400 comprising a spherical body 425. The plurality of massage fingers 110 on massage apparatus 400 may be arranged and spaced based on a theoretical polyhedron as previously described, so as to correspond with the locations of the vertices of a particular polyhedron. The intersection of the massage fingers 110 and the spherical body 425 may comprise a filleted intersection 405, or any type of intersecting planes.

Figure 5:
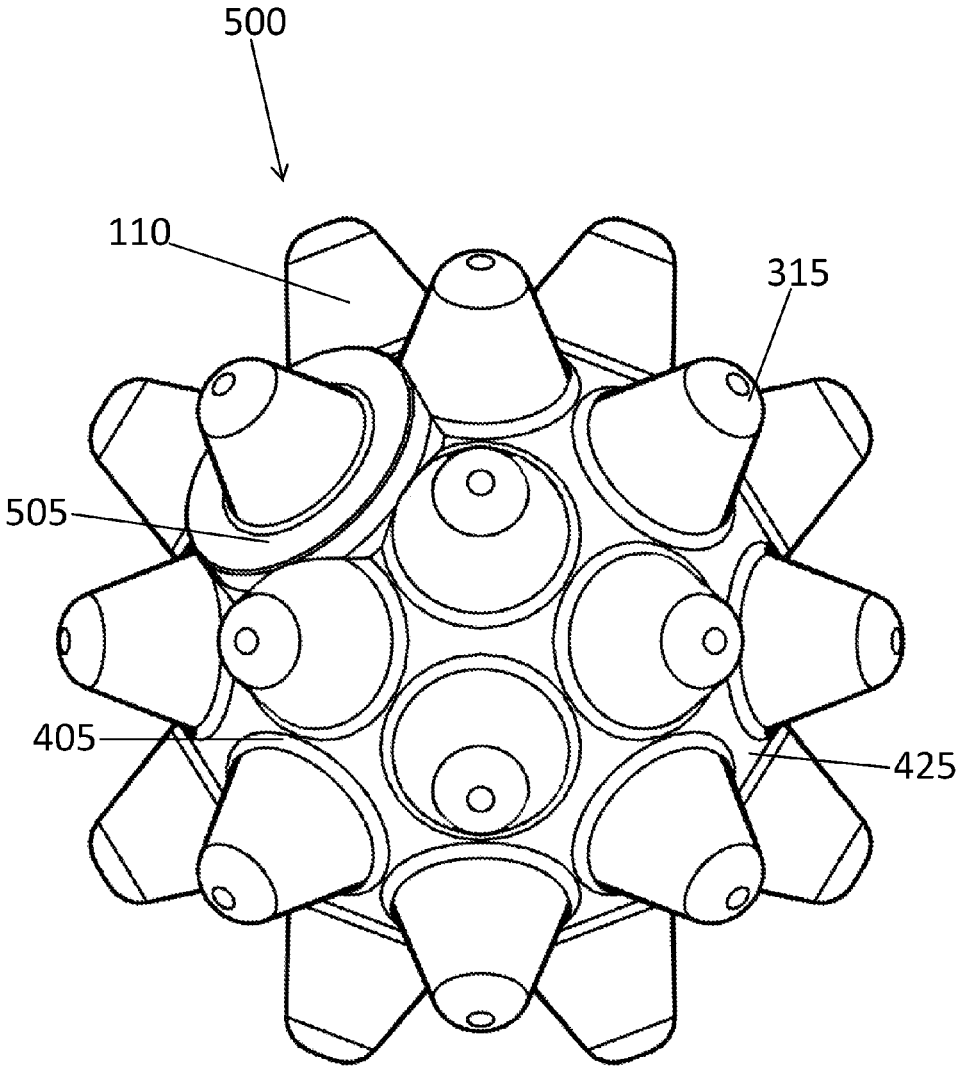
FIG. 5 is a front view of a fourth implementation of a massage apparatus.

Referring now to FIG. 5, illustrating a massage apparatus 500 further comprising a boss 505 at the base of at least one massage finger 110. Other implementations may comprise a boss 505 at the base of any number of the massage fingers 110. The plurality of massage fingers 110 on massage apparatus 500 may be arranged and spaced based on a theoretical polyhedron as previously described, so as to correspond with the vertices a particular polyhedron. As illustrated in FIG. 5, the boss 505 comprises a cylindrical configuration that circumnavigates or surrounds at least a portion of the inward base of the massage finger 110. In other implementations, the boss 505 may comprise any shape or finishing edge around the massage finger 110 that allows the massage finger 110 to locate onto or within another opening of a separate massage apparatus, thus locating or joining the massage apparatus 500 with another massage apparatus. For example, the particular massage finger 110 comprising the boss 505 at the base may be sized, shaped, or otherwise configured to fit within a substantially conical hole, void, or depression on a separated massage apparatus (shown in greater detail in FIG. 6).

The boss 505 may further comprise any type of coupling element, such as but not limited to magnets, adhesive, screw threads, pins, and the like. In an embodiment, a magnet may be place under the surface of the boss 505 such that the magnet does not decrease performance of the massage apparatus 500, but may nonetheless still be attracted to metal or an opposite poled magnet. In this and any other implementations discussed herein, the massage fingers 110 may be configured to be removably coupled to the base 125, 425. The removable coupling of a massage finger 110 to the base 125, 425 may work by way of magnets, adhesive, screw threading, pins, or any other elements for removable coupling. In particular implementations, the boss 505 may simply be used as a marking location for marking the massage ball with a product name or manufacturer name. Nevertheless, the inclusion of the boss 505 surrounding a massage finger 110 does not interrupt the placement of the remaining massage fingers 110.

Figure 6:
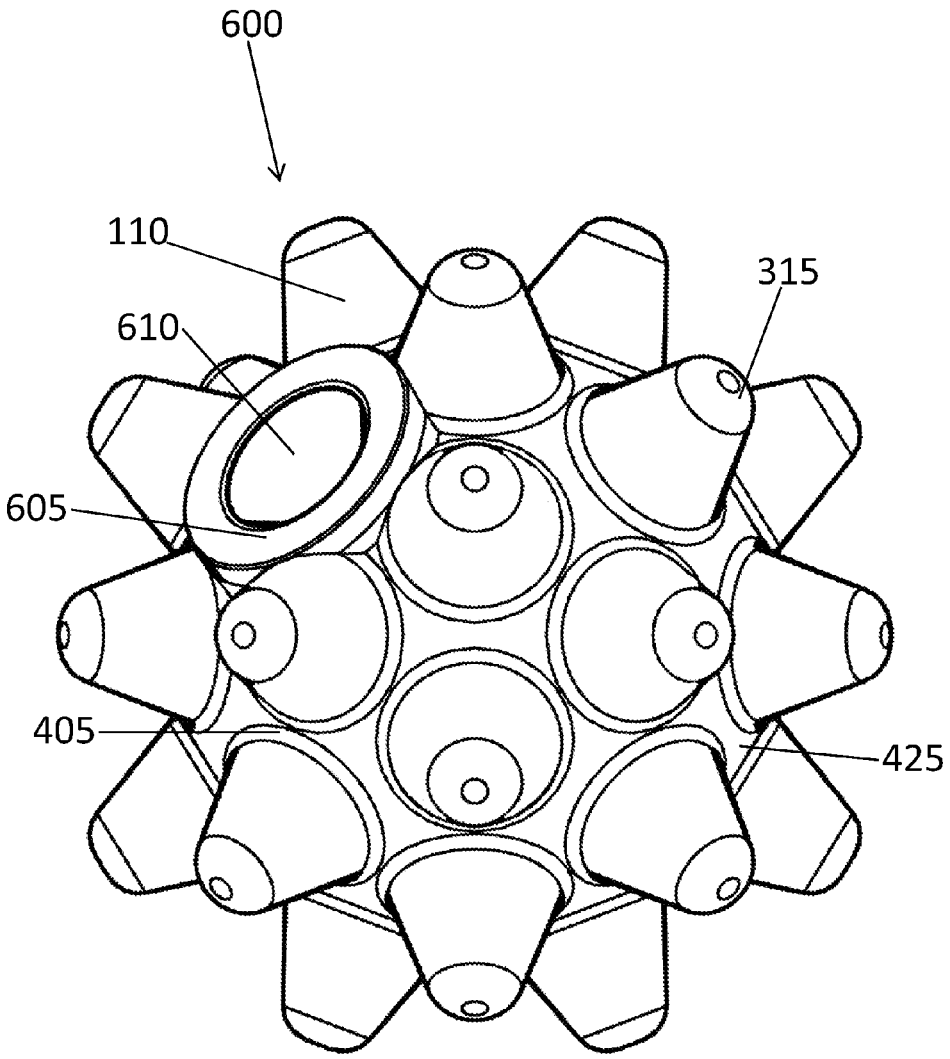
FIG. 6 is a front view of a fifth implementation of a massage apparatus.

Referring now to FIG. 6, illustrating a massage apparatus 600 comprising a recessed receiving element 610 in place of a massage finger 110. Other implementations may comprise any number of recessed receiving elements 610 in place of any number of massage fingers 110. The recessed receiving element 610 may comprise any type of recess, hole, void, channel, through-hole, or depression sized, shaped, or otherwise configured to receive a massage finger 110 from separate massage apparatus, a post or handle from a massage grip, or any other type of connecting apparatus.

The recessed receiving element 610 may be surrounding by a boss 605. As illustrated in FIG. 6, the boss 605 comprises a cylindrical configuration that circumnavigates or surrounds the recessed receiving element 610. In particular implementations, the receiving element 610 extends all the way through the body 425 so that a handle can be extended through the massage ball 600 for convenient handling and use of the massage ball. In other implementations, the boss 605 may comprise any shape or finishing edge around the recessed receiving element 610 that allows the recessed receiving element to locate onto or within another opening of a separate massage apparatus, thus locating or joining the massage apparatus 600 with another massage apparatus or connecting apparatus. For example, recessed receiving element 610 may be sized, shaped, or otherwise configured to hold similarly sized, shaped, or otherwise configured protrusion on another massage apparatus or connecting apparatus. In an implementation, the boss 605 may mate with a boss receiver on another massage apparatus or connecting apparatus.

With the exception of the at least one recessed receiving element 610, the plurality of massage fingers 110 on massage apparatus 600 may be arranged and spaced based on a theoretical polyhedron as previously described, so as to correspond with the vertices of a particular polyhedron. For example, in an implementation with massage fingers 110 placed to align with the vertices of a theoretical pentakis dodecahedron, the massage apparatus may comprise thirty or thirty-one massage fingers 110 corresponding to thirty or thirty-one vertices and two or one recessed receiving element 610 corresponding to two or one vertex of the thirty-two vertices of the theoretical pentakis dodecahedron. In a particular implementation, two recessed receiving elements 610 are included on exactly opposite, aligning positions of the massage apparatus 600. In other implementations, regardless of theoretical polyhedron, a recessed receiving element 610 may be aligned with a vertex of the polyhedron in place of a massage finger 110.

Figure 7:
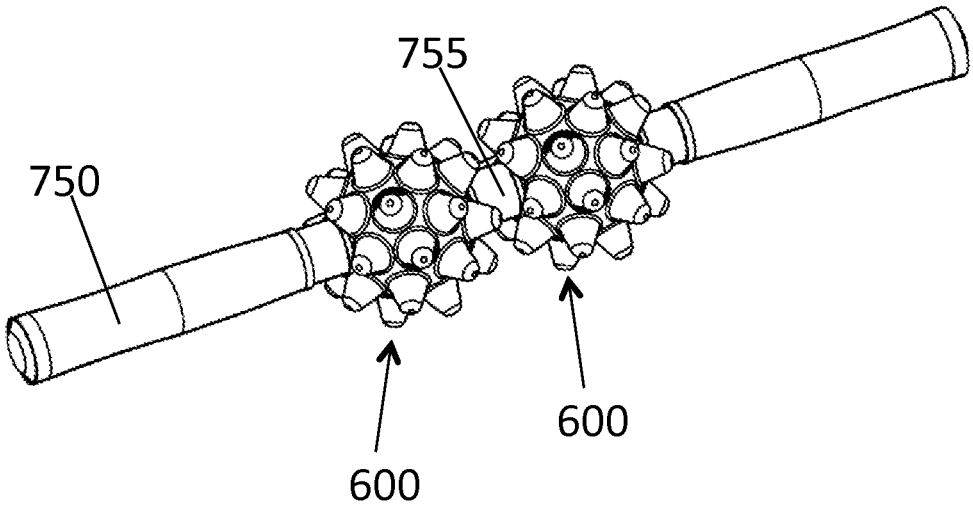
FIG. 7 is a perspective view of a massage apparatus and massage bar.

Referring now to FIG. 7, illustrating a plurality of massage apparatuses 600 coupled to massage bar 750. In a particular implementation, the massage apparatus 600 may be void of two massage fingers 110 on opposing sides of the massage apparatus 600. The recessed receiving elements 610 replacing each of the two voided massage fingers are aligned with two opposing vertex axes 115 of a polyhedron. The recessed receiving elements may be further configured to continue until the two receiving elements 610 meet, thus forming a channel, hole or void that continues through the massage apparatus 600. Such an implementation may be configured to receive a massage bar 750 or rod that extends through the massage apparatus 600. The massage bar 750 may extend through a second massage apparatus or may alternatively connect to a similarly coupled second massage apparatus and bar. A spacer 755 may be placed on the massage bar 750 between adjacent massage apparatuses 600.

In an alternative implementation, the massage bar 750 may comprise a tip configured to mate with the receiving element 610 of the massage apparatus 600 and removably couple the massage bar 750 to the massage apparatus 600. Two massage apparatuses 600 may be removably coupled together with a spacer 755 adapted to couple to each of two massage apparatuses 600, one at either end. The spacer 755 may either fit within recessed receiving elements 610 of the massage apparatus 600, or hold massage fingers 110 of the massage apparatus 600. Bosses 505, 605 may assist in coupling the massage apparatus 500, 600 to the spacer 755 and/or the massage bar 750.

Coupling of various implementations of massage apparatuses 600 to the massage bar 750 comprises a pivotal mounting that allows the massage apparatus 600 to roll and rotate over a body or other surface while the massage bar 750 handles do not rotate. Rotation of the massage apparatus(es) 600 is typically about a center axis of the massage bar 750. Configuration of the rolling massage apparatus(es) coupled to the massage bar 750 allows for effective use of the massage apparatus(es) 600 over a greater amount of body area. For example, a user of the combined massage bar 750 and massage apparatus(es) 600 may reach and massage other body areas for self massage, or a therapist or massage assistant may use the bar to assist in providing a deeper massage in particular situations.

Figure 8:
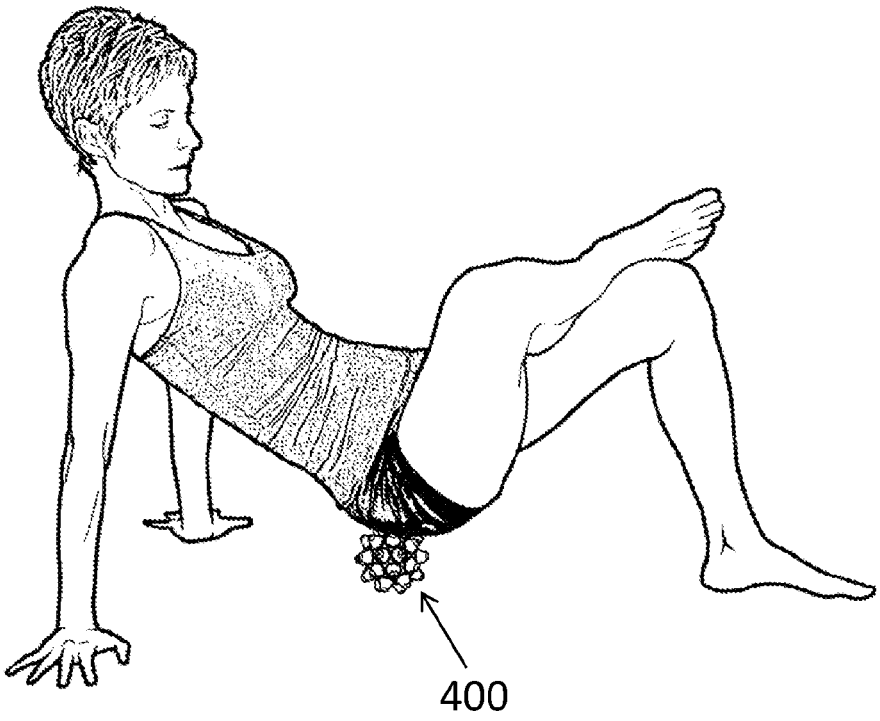
FIG. 8 is a perspective view of an exemplary use of a massage apparatus.

Referring now to FIG. 8, illustrating an exemplary use of a massage apparatus 400. Although massage apparatus 400 is illustrated in FIG. 8, any massage apparatus disclosed herein may be utilized in similar fashion. The massage apparatus 400 may be placed between a user and a surface, such as a floor, wall, ground, door, window, etc. The massage apparatus 400 may be further used by pressing the massage apparatus 400 against a user's body with the user's own hands or the hands of another individual. Due to the spacing, configuration, and/or number of massage fingers 110 on the massage apparatus 400, the massage apparatus 400 effectively, consistently and evenly rolls between the user and the surface, by evenly moving across the floor due to the regular and consistent spacing of the massage fingers 110. The spacing, configuration, and number of massage fingers 110 further allows for individual massage fingers 110 to effectively reach the soft tissue of the user.

It will be understood that implementations are not limited to the specific components disclosed herein, as virtually any components consistent with the intended operation of a method and/or system implementation for massage apparatuses may be utilized. Accordingly, for example, although particular massage apparatuses may be disclosed, such components may comprise any shape, size, style, type, model, version, class, grade, measurement, concentration, material, weight, quantity, and/or the like consistent with the intended operation of a method and/or system implementation for massage apparatuses may be used.

In places where the description above refers to particular implementations of massage apparatuses, it should be readily apparent that a number of modifications may be made without departing from the spirit thereof and that these implementations may be applied to other massage apparatuses. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A massage apparatus, comprising:

a body comprising an array of a plurality of massage fingers, the plurality of massage fingers consisting essentially of at least thirty and no more than thirty-two massage fingers each comprising an outward tip, an inward base, and a center axis central to the outward tip and the inward base, the center axis extending to a center of the body, wherein the plurality of massage fingers are spaced about the body such that the center axis of each of the plurality of massage fingers is positioned to correspond to a location of a different one of thirty-two vertices of a theoretical pentakis dodecahedron having a center point corresponding to the center of the body and align with a different one of thirty-two vertex axis extending from the center point of the theoretical pentakis dodecahedron through one of the thirty-two vertices of the theoretical pentakis dodecahedron.

2. The massage apparatus of claim 1, wherein the plurality of massage fingers consists essentially of thirty-two massage fingers each positioned to correspond to the location of a different one of the thirty-vertices of the theoretical pentakis dodechedron.

3. The massage apparatus of claim 2, wherein each of the thirty-two massage fingers are frustoconical.

4. The massage apparatus of claim 3, wherein the outward tip of each massage finger of the thirty-two massage fingers is flat.

5. The massage apparatus of claim 3, wherein the outward tip of each massage finger of the thirty-two massage fingers is rounded.

6. The massage apparatus of claim 5, wherein the thirty-two massage fingers and the body meet at filleted intersecting edges.

7. The massage apparatus of claim 2, wherein the body comprises a spherical body, the thirty-two massage fingers extend at least 0.6 centimeters from the body, and the massage apparatus comprises a diameter of between 5 and 15 centimeters.

8. The massage apparatus of claim 7, wherein the massage apparatus comprises a diameter of approximately 8 centimeters.

9. The massage apparatus of claim 1, wherein the array of massage fingers consists essentially of thirty massage fingers, each center axis of the thirty massage fingers aligning with the vertex axis of one of the thirty-two vertices of the theoretical pentakis dodecahedron.

10. The massage apparatus of claim 6, wherein the center axes of the thirty massage fingers are each aligned with the vertex axis of one of the thirty-two vertices of the pentakis dodecahedron such that two vertices of the thirty-two vertices on opposing sides of the body are void of massage fingers.

11. The massage apparatus of claim 10, wherein the two vertices void of massage fingers each comprise a recessed receiving element.

12. The massage apparatus of claim 11, further comprising a bar extending through the body such that the body is pivotally mounted on the bar.

13. The massage apparatus of claim 12, further comprising a second body pivotally mounted to the bar adjacent to the first body.

14. The massage apparatus of claim 1, wherein the body comprises a thermoplastic elastomer material.

15. A massage apparatus, comprising an array of a plurality of massage fingers, the plurality of massage fingers consisting essentially of thirty-two massage fingers arranged on a body, each massage finger comprising an outward tip and a center axis central to the outward tip such that the center axis of each of the thirty-two massage fingers aligns with a different one of thirty-two vertex axes that extend from a body center point formed by an intersection corresponding to each vertex axis to one of thirty-two vertices of a theoretical pentakis dodecahedron having a center point corresponding to the body center point.

16. The massage apparatus of claim 15, wherein the thirty-two massage fingers are each frustoconical in shape and comprise an inward base and an outward tip, the outward tip smaller in area and at a greater distance from the center point than the inward base.

17. The massage apparatus of claim 16, wherein intersections formed by intersection of the thirty-two massage fingers and the body are filleted.

18. The massage apparatus of claim 16, wherein the body is spherical.

19. The massage apparatus of claim 15, wherein the thirty-two massage fingers are frustoconical and extend at least 0.6 centimeters from the body.

* * * * *